United States Patent [19]

Bratton et al.

[11] 4,376,004

[45] Mar. 8, 1983

[54] METHOD OF MANUFACTURING A TRANSPIRATION COOLED CERAMIC BLADE FOR A GAS TURBINE

[75] Inventors: Raymond J. Bratton, Delmont; Clarence A. Andersson, Pittsburgh, both of Pa.

[73] Assignee: Westinghouse Electric Corp., Pittsburgh, Pa.

[21] Appl. No.: 197,318

[22] Filed: Oct. 15, 1980

Related U.S. Application Data

[62] Division of Ser. No. 3,849, Jan. 16, 1979, Pat. No. 4,311,433.

[51] Int. Cl.[3] ..... C04B 39/00; F01D 5/08

[52] U.S. Cl. ..... 156/89; 29/156.8 H; 416/97 A; 416/241 B

[58] Field of Search ..... 29/156.8 H, 156.8 B, 29/163.5 R; 416/97 A, 97 R, 241 B, 230, 231 R; 156/89, 185, 187

[56] References Cited

U.S. PATENT DOCUMENTS

| | | | |
|---|---|---|---|
| 2,751,188 | 6/1956 | Rath | 416/241 B |
| 2,873,947 | 2/1959 | Perry | 416/241 B |
| 3,011,760 | 12/1961 | Eckert | 416/90 |
| 3,131,535 | 5/1964 | Hensley | 29/157 C |
| 3,293,072 | 12/1966 | Doolittle et al. | 428/430 |
| 3,620,643 | 11/1971 | Jones | 416/97 A |
| 3,647,316 | 3/1972 | Moskowitz | 416/97 A |
| 3,656,863 | 4/1972 | DeFeo | 416/97 A |
| 3,672,787 | 6/1972 | Thorstenson | 416/231 R |
| 3,709,632 | 1/1973 | Emmerson et al. | 416/97 A |
| 3,725,186 | 4/1973 | Lynch | 156/89 |
| 3,770,529 | 11/1973 | Anderson | 156/89 |
| 3,810,711 | 5/1974 | Emmerson et al. | 416/97 A |
| 3,886,647 | 6/1975 | Alexander | 228/193 |
| 3,950,114 | 4/1976 | Helms | 416/97 A |
| 4,004,056 | 1/1977 | Carroll | 416/231 R |
| 4,022,542 | 5/1977 | Barbeau | 416/97 A |
| 4,042,162 | 8/1977 | Meginnis et al. | 29/156.8 H |
| 4,046,612 | 9/1977 | Warner et al. | 156/89 |
| 4,067,662 | 1/1978 | Rossman | 416/241 B |
| 4,118,146 | 10/1978 | Dierberger | 416/97 A |

FOREIGN PATENT DOCUMENTS

| | | | |
|---|---|---|---|
| 653267 | 5/1951 | United Kingdom | 416/248 |
| 885322 | 12/1961 | United Kingdom . | |
| 1523828 | 9/1978 | United Kingdom . | |

OTHER PUBLICATIONS

"Application and Firing Instructions for Transfer Tapes" from Vitta Corporation Publication, Wilton, Conn., Bulletin No. AI-01, Aug., 1971.

*Primary Examiner*—Daniel C. Crane
*Attorney, Agent, or Firm*—E. F. Possessky

[57] ABSTRACT

A transpiration cooled ceramic blade for a gas turbine is shown wherein a spar or strut member defining a root portion and an airfoil portion provides the main structural component of the blade. The air foil portion contains longitudinal grooves in the surface in flow communication with an air flow passage in the root portion and a flexible perforated ceramic tape is wrapped around the air foil portion with the perforations therein in registry with the grooves in the core. The flexible ceramic tape and the strut assembly are heated initially to a low temperature to drive off the binder forming the tape and then heated to a relatively high temperature to fuse the ceramic component of the tape together and to the strut to form a unitary blade structure with internal air flow paths and transpiration cooling orifices through the skin.

2 Claims, 4 Drawing Figures

METHOD OF MANUFACTURING A TRANSPIRATION COOLED CERAMIC BLADE FOR A GAS TURBINE

This is a division of application Ser. No. 3,849, filed Jan. 16, 1979, now U.S. Pat. No. 4,311,433, issued 1-1-9-82.

BACKGROUND OF THE INVENTION

1. Field of the Invention

This invention relates to a transpiration cooled blade for a combustion turbine engine and more particularly to a transpiration cooled ceramic blade and the method of its fabrication.

2. Description of the Prior Art

It is well known in the combustion turbine field that as the temperature of the motive fluid for the combustion turbine increases, the efficiency of the engine also increases. However, the temperature of the combustion gases are generally limited because of the inability of the material forming the blades and vanes in the combustion turbine to withstand temperatures greater than approximately 2000° F. To permit combustion gases of a higher temperature, the blades must be cooled to within their allowable operating temperatures. It is now common practice to form the blades and vanes with a high temperature alloy; however, it is also known that blades fabricated from a ceramic material would withstand an even higher temperature and therefore permit a higher temperature for the motive fluid gases with less cooling requirements for the blade, which ultimately yields a much more efficient combustion turbine engine.

There are broadly two distinct methods for combustion turbine blade cooling. The first method is to direct a cooling fluid through internal passages in the blade, permitting the fluid to be discharged into the motive fluid flow path of the turbine, once it has absorbed sufficient heat from the internal structure, through orifices generally in the tip or trailing edge of the blade. A second and more efficient blade cooling method is to deliver a cooling fluid such as air into an internal portion of the blade and permit it to flow through a porous blade surface from both the suction and pressure side of the blade which provides a preliminary cooling effect but primarily envelopes the exterior surface of the blade with a thin film of relatively cool air to prevent impingement thereon of the hot motive gases. This latter method is generally referred to as transpiration cooling.

A transpiration cooled metal blade for a combustion turbine engine is disclosed in U.S. Pat No. 3,810,711 and comprises a porous metal facing preformed to closely fit over the air foil portion of a blade strut and then diffusion bonded thereto. The strut, in addition to being hollow, has orifices formed in the airfoil portion to permit air to escape therethrough and ultimately through the porous facing blade surface.

Although able to withstand a higher temperature, ceramic material is generally brittle. This requires that blades fabricated from ceramic have a substantial cross-sectional area to withstand the centrifugal forces imposed thereon and also have configurations which produce minimal stress concentrations. Methods have been developed for producing solid, monolithic ceramic blades, such as by machining them from solid ceramic billets or by hot pressing them to the desired shape. However, neither of these methods is conducive to producing the internal air flow channels and minute surface orifices needed to distribute the cooling air in the manner required for transpiration cooling. Further, when fabricating a ceramic blade to include air passages and orifices, care must be taken to ensure that the remaining structure has sufficient strength with minimal stress concentrating features to withstand the forces (e.g. both centrifugal force and bending forces) experienced by blades in the combustion turbine engine.

SUMMARY OF THE INVENTION

The present invention provides a combustion turbine blade constructed with a central strut member defining a root portion and an airfoil portion. The airfoil portion of the strut has longitudinal grooves formed therein extending from adjacent the tip and in air flow communication with an air channel formed in the root portion. The strut forms the main structural component of the blade. A ceramic skin is fabricated from multiple layers of a flexible ceramic tape which is cut and perforated while in the flexible (e.g. green) state. The polymer binder provides sufficient adhesiveness to the tape so that it can be wrapped around the airfoil portion of the strut and to itself for temporary adherence therebetween. The strut and skin thus assembled are heated, initially to a temperature sufficient to drive off the polymer binder in the tape and thence to a sufficient temperature to fuse the ceramic component of the tape together and to the strut member to form a unitary structure with the strut and thereby providing a porous ceramic surface in air flow communication with the air channels in the strut.

DESCRIPTION OF THE PREFERRED EMBODIMENT

Figure 1:
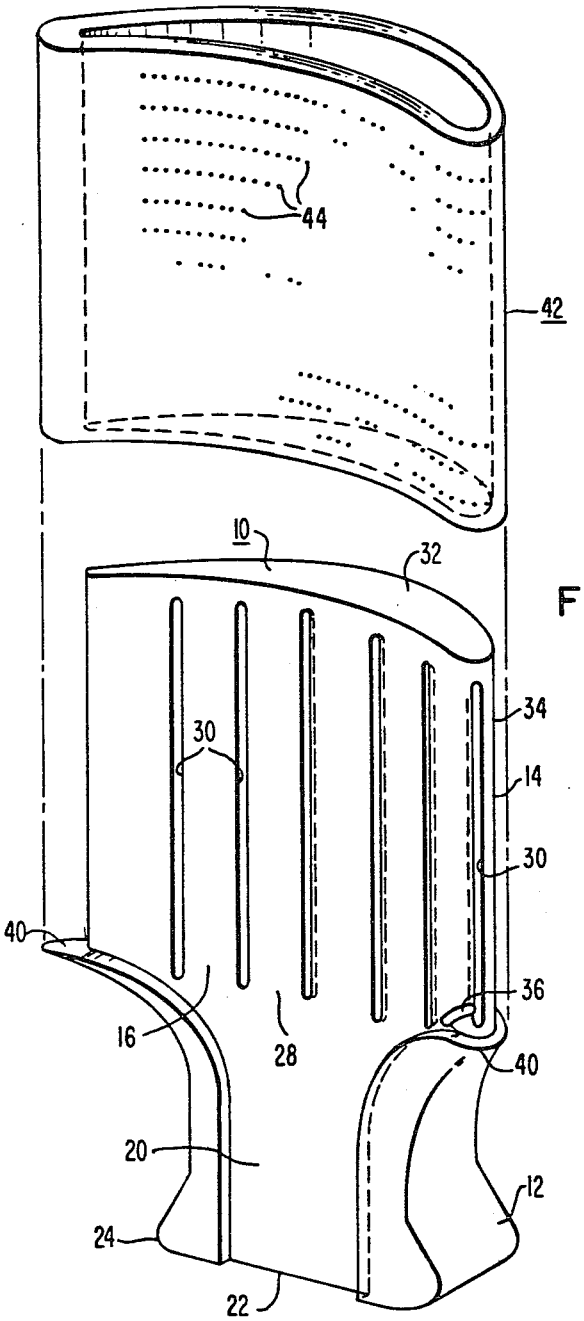
FIG. 1 is an isometric exploded assembly of the blade strut and skin according to the present invention.
Figure 2:
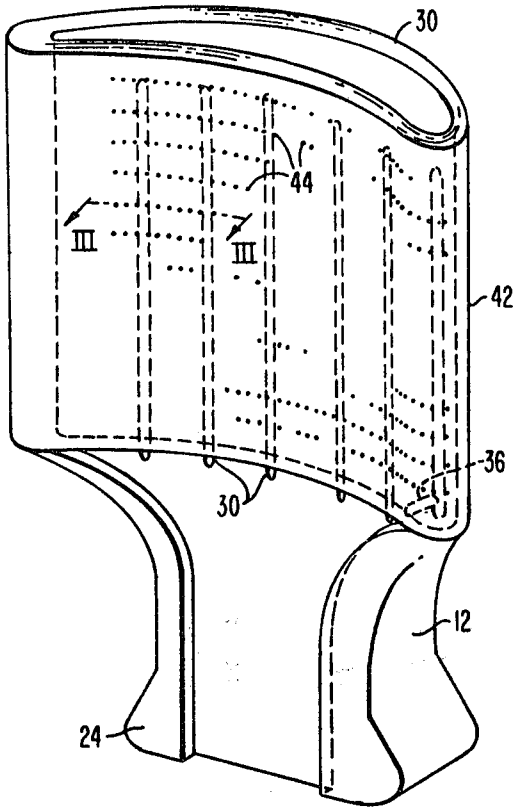
FIG. 2 is an isometric view of the strut and skin in assembled relationship.

The present invention, as shown in FIGS. 1 and 2 comprises a central strut member 10 preferably formed from a fully dense high strength ceramic such as silicon nitride ($Si_3N_4$) or silicon carbide (SiC), either sintered or hot pressed into a shape generally defining a root portion 12 and an airfoil portion 14 which is machine finished to the desired final dimensions and shape. The core or strut 10 could also be formed from a suitable metal or in the alternative the airfoil portion 14 thereof could be formed from a fully dense high strength ceramic such as previously identifed and the root portion 12 formed of a metal with the two bonded together as known in the art.

Figure 4:
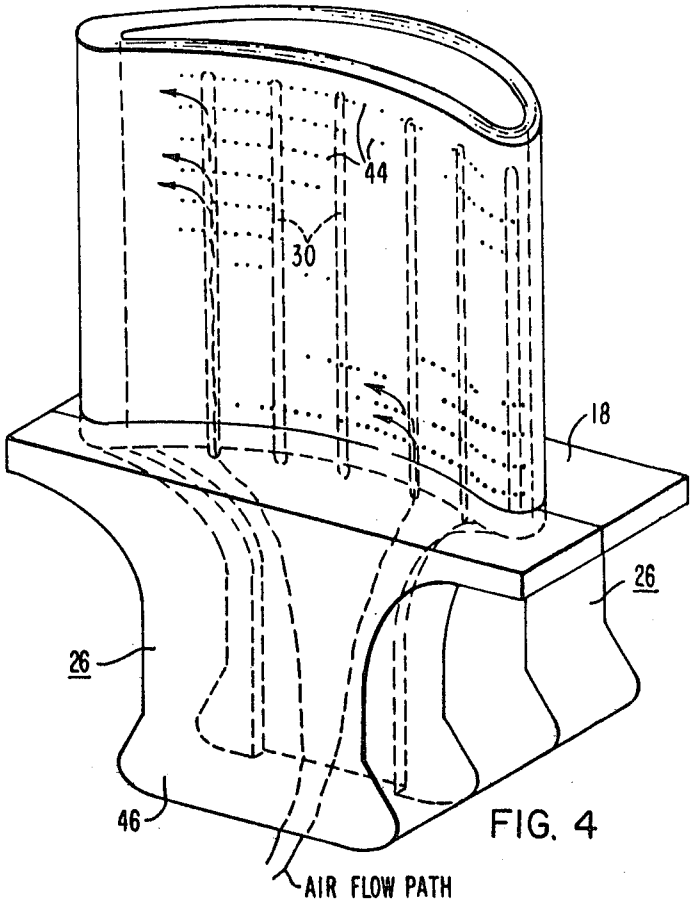
FIG. 4 is an isometric view of the completely assembled blade of the present invention.

The juncture of the root portion 12 with the airfoil portion 14 defines an intermediate portion 16 generally associated with the area for the blade platform 18 (see FIG. 4 for a complete blade assembly including segments forming the blade platform).

Only one face of the strut 10 is shown, however it is to be understood that the opposite surfaces of the respective portions of the faces shown are similarly constructed. Thus, as is seen, the root portion 12 includes an inwardly recessed area 20 open to the bottom 22 and having marginal raised faces 24 which, when in facing engagement with an adjacent root portion of a separate platform segment 26 (again as shown in FIG. 4) defines a cooling air inlet channel 28 through the root portion. The airfoil portion 14 has a plurality of generally vertically oriented channels 30 extending generally from below the intermediate portion 16 to sub-adjacent the blade tip 32. One of the channels 30 on the leading edge 34 of the airfoil portion includes a short generally transverse channel 36 extending to the recess portion 20 in the side of the blade root.

As is seen, the airfoil portion 14 is somewhat recessed from the outermost surfaces of the root portion 12 so that a shoulder 40 is defined at their juncture in the intermediate portion 16, with the lowermost ends of the channels 30 extending somewhat below such shoulder.

A generally porous ceramic skin 42 is disposed over the airfoil portion of the strut with the lowermost marginal edge thereof abutting the shoulder 40 and the upper edge generally flush with the upper surface or tip 32 of the strut 10. The ceramic skin 42 is fabricated preferably from multiple layers of a ceramic tape such as is available from the Vitta Corporation, 382 Danburry Road, Wilton, Connecticut and generally described in a brochure describing the "Application And Firing Instructions For Transfer Tapes", Vitta Corporation Bulletin No. Al-0, revised August 1971, and in U.S. Pat No. 3,293,072. Generally, such ceramic tape comprises a ceramic powder, which for the purpose of this invention is preferably a silicon nitride or a silicon carbide mixed with a polymer binder dissolved in a solvent. The dispersion is spread to a desired uniform thickness and the solvent evaporated to form a flexible sheet or tape. In the commercially available form, the ceramic containing sheet is retained between a carrier film, such as a Mylar film, and a release paper back. In such form, it is contemplated for the purpose of making it a porous blade skin in accordance with this invention, to cut the tape to the desired size for enveloping the airfoil portion 14 of the strut 10 as shown and to perferate the tape in a desired pattern with metal punches and dyes.

The ceramic tape because of its polymer binder, is substantially inherently tacky so that upon being removed from the carrier film it can generally adhere to a surface for temporary application and retention thereon. Thus, still referring to FIGS. 1 and 2, the punched ceramic tape forming the skin 42 is secured over the airfoil portion 14 of the strut 10 with the openings 44 therethrough in proper registry with the channels 30 in the strut. This assembly is then fired, initially to a temperature to drive off the polymer binder in the tape and to an ultimate temperature in a suitable atmosphere to sinter or reaction sinter the silicon carbide or silicon nitride content of the tape. Self bonding between the sintered skin 42 and the strut 10 during such processing provides sufficient adhesion to retain the skin 42 on the strut during operation of the blade within a combustion turbine; however, it is also contemplated that the bonding between the two could be increased by a thin interfacial bond material such as magnesium silicon oxide $MgSiO_3$ or yttrium silicon oxide when the skin is formed of a ceramic tape of silicon nitride.

Figure 3:
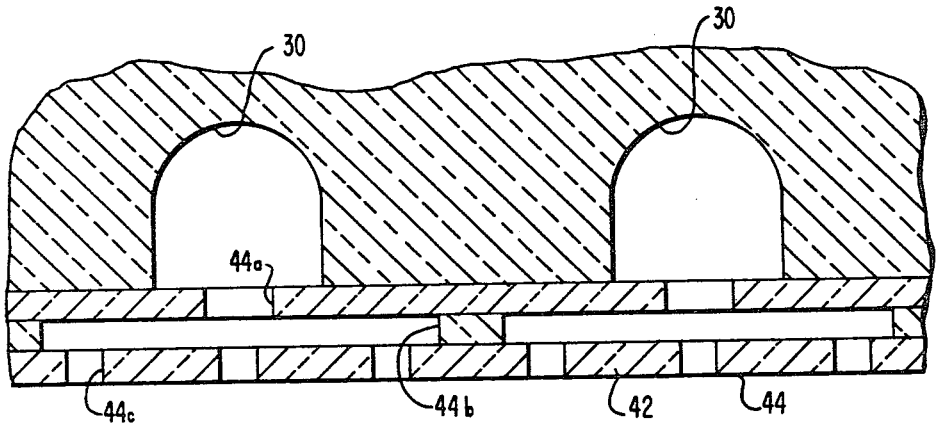
FIG. 3 is an enlarged cross-sectional view through a portion of the skin and strut of the blade.

Referring now to FIG. 3, it is seen that the ceramic skin 42 comprises multiple layers **42*a*, 42*b*, 42*c* of a punched ceramic tape. In this configuration three layers are shown, with the initial layer 42*a* defining apertures 44*a* in alignment with the channels 30 in the strut. The intermediate layer 42*b* acts much like a manifold by defining apertures 44*b* for placing the single aperture 44*a* of the initial layer in communication with multiple apertures 44*c* in the final outer layer 42*c*. However, it is also evident that surface corrugations or projections on the initial layer 42*a* could supplant the internal layer 42*b* and provide spacial separation for air flow communication between the generally widely spaced apertures 44*a* in the initial layer and the plurality of closely spaced apertures 44*c* in the final layer 42*c*** to provide air flow distribution evenly over the surface of the blade.

The complete blade assembly, shown in FIG. 4, includes a pair of blade platform segments 26, separate from the strut member, but having root configuration 46 similar to the root portion 12 of the strut 10 for retention of the assembly in a mating groove in a stationary or rotating part of the gas turbine engine as is well known. The platform segments 26 cooperate with the root portion of the strut to enclose the air flow paths (e.g. the recessed area 20 on each side of the strut root) for confined cooling air flow delivery to the channels 30 in the air flow portion of the strut. Again these segments will preferably be fabricated of the same material (high density ceramic or a high temperature metal alloy,) as the root portion of the strut.)

Thus, a transpiration cooled combustion turbine blade is shown having a ceramic airfoil portion permitting a higher blade temperature and thus requiring less cooling air than heretofore. The internal support for the airfoil portion is also preferably fabricated from a hot-pressed or sintered fully dense high strength ceramic (although a metal strut would also be acceptable upon close matching of the expansion characteristics between the strut and the ceramic skin). The airfoil portion of the strut is machined to a reduced periphery to accept a ceramic skin thereover and contains longitudinal surface grooves machined or formed therein acting as primary air channels.

To facilitate the ease of fabrication, each side of the blade platform is made separately and after application of the flexible ceramic tape to the strut, the two opposed platform segments can be positioned over the terminal marginal portion 48 (See FIG. 4) of the skin to form a sealed air passage into the channels 30. If additional sealing is required, a thin foil of a high melting point oxidation resistant metal such as platinum or one of the nickel or cobalt based alloys may be interposed between the ceramic components. Alternatively, a high temperature, high viscosity glass may be used as a seal. These sealants would be required to have only minimal strength since mechanical loadings thereon would be low.

What we claim as our invention:

1. A method of fabricating a transpiration cooled combustion turbine blade having a ceramic airfoil surface comprising the steps of:

providing a blade strut member having a root portion and an airfoil portion;

forming cooling fluid flow paths in said strut member for coolant fluid flow communication between said root portion and said airfoil portion;

forming a ceramic skin about said airfoil portion by wrapping said airfoil portion with multiple layers of unfired ceramic tape having pre-punched apertures therein for registry with said coolant paths thereby permitting coolant flow from said path through all layers of said skin; and bonding by firing said ceramic tape on said airfoil portion to fuse the layers of tape together and the tape to said strut member.

2. A method according to claim 1 wherein said strut is formed from ceramic material and said bonding step further comprises:

placing an interfacial bond material between said ceramic strut and the facing layer of said ceramic tape prior to said firing to facilitate said fusion therebetween.

* * * * *